United States Patent [19]

Genbauffe et al.

[11] Patent Number: 4,927,996

[45] Date of Patent: May 22, 1990

[54] COOKING APPARATUS, DOOR LATCHING CONSTRUCTION THEREFOR AND METHODS OF MAKING THE SAME

[75] Inventors: Francis S. Genbauffe, Irwin; Steven A. Kimmel, Greensburg, both of Pa.

[73] Assignee: Robertshaw Controls Company, Richmond, Va.

[21] Appl. No.: 197,288

[22] Filed: May 23, 1988

[51] Int. Cl.[5] ..... F24C 7/08; H05B 1/02

[52] U.S. Cl. ..... 219/413; 292/123; 292/DIG. 69; 126/197

[58] Field of Search ..... 219/412, 413, 414; 126/192, 197; 292/109, 333, 123, 122, 201, 97, DIG. 69

[56] References Cited

U.S. PATENT DOCUMENTS

| | | | |
|---|---|---|---|
| Re. 27,545 | 1/1973 | Guy | 219/412 |
| 3,409,320 | 11/1968 | Eckerle | 292/DIG. 69 |
| 3,410,591 | 11/1968 | Fowler | 292/DIG. 69 |
| 3,476,424 | 11/1969 | Erickson | 292/DIG. 69 |
| 3,875,372 | 4/1975 | Gilliom | 219/413 |
| 3,889,654 | 6/1975 | Kauranen et al. | 126/194 |
| 4,082,078 | 4/1978 | Thuleen | 292/DIG. 69 |
| 4,351,288 | 9/1982 | Gasloli | 126/192 |
| 4,623,179 | 11/1986 | Davis | 292/DIG. 69 |

*Primary Examiner*—Teresa J. Walberg

*Attorney, Agent, or Firm*—Candor, Candor & Tassone

[57] ABSTRACT

A cooking apparatus, a door latching construction therefor and methods of making the same are provided, the cooking apparatus including a frame, a cooking chamber carried by the frame, a heating unit carried by the frame and being adapted to be actuated to heat clean the chamber, a switch for permitting the heating unit to heat clean the chamber only when the switch is actuated, a movable door carried by the frame for opening and closing the cooking chamber, a movable latch member carried by the frame and being movable between a non-latching position thereof that permits the door to be opened and closed and a latching position thereof that locks the door in its closed position if the door is in its closed position at the time the latch member is moved to the latching position thereof, and a drive unit carried by the frame and being operatively interconnected to the latch member to move the latch member between the positions thereof, the latch member being movable from the non-latching position thereof to a third position thereof by the drive unit when the drive unit tends to move the latch member from the non-latching position thereof to the latching position thereof when the door is not in a closed condition thereof, the latch member being adapted to actuate the switch only when the latch member is in the latching position thereof.

26 Claims, 8 Drawing Sheets

COOKING APPARATUS, DOOR LATCHING CONSTRUCTION THEREFOR AND METHODS OF MAKING THE SAME

BACKGROUND OF THE INVENTION

1. Field of the Invention

This invention relates to a new cooking apparatus and to a new door latching construction for a cooking apparatus as well as to new methods of making the same.

2. Prior Art Statement

It is known to provide a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in its closed position if the door means is in its closed position at the time the latch member is moved to the latching position thereof, and drive means carried by the frame means and being operatively interconnected to the latch member to move the latch member between the position thereof. For example, see the U.S. Pat. to Kauranen et al; No. 3,889,654; the U.S. Pat. to Gilliom, No. 3,875,372 and the U.S. Pat. to Guy, RE, 27,545.

SUMMARY OF THE INVENTION

One feature of this invention is to provide a new oven door latching construction for a cooking apparatus or the like wherein the movable latch member of the latching construction is uniquely utilized to sense whether or not the oven door means is in a closed position thereof and is so constructed and arranged that the latch member itself will only be adapted to operate an electrical switch means when that latch member is in a latching position thereof, the switch means permitting the heating means of the cooking apparatus to heat clean the cooking chamber means thereof only when that switch means is actuated by the latch member being in its latching position.

In particular, it was found according to the teachings of this invention that the latch member of a door latching construction can be so constructed and arranged that the same will be moved to a position other than its latching position when the drive means interconnected thereto tends to move the latch member from its non-latching position to its latching position if the door means is not in the closed position thereof whereby the latch member can only be moved to its latching position when the door means is in its closed position and the drive means is operated to move the latch member from its non-latching position to its latching position. With such an arrangement, it was also found according to the teachings of this invention that an electrical switch means can be provided for permitting the heating means of the cooking apparatus to heat clean the chamber means only when that switch means is actuated and that that switch means can be arranged so as to be actuated by the latch member only when the latch member is moved to its latching position.

For example, one embodiment of this invention provides a cooking apparatus comprising a frame means, a cooking chamber means carried by the frame means, heating means carried by the frame means and being adapted to be actuated to heat clean the chamber means, switch means for permitting the heating means to heat clean the chamber means only when the switch means is actuated, a movable door means carried by the frame means for opening and closing the cooking chamber means, a movable latch member carried by the frame means and being movable between a non-latching position thereof that permits the door means to be opened and closed and a latching position thereof that locks the door means in its closed position if the door means is in its closed position at the time the latch member is moved to the latching position thereof, and drive means carried by the frame means and having moving means operatively interconnected to the latch member to move the latch member between the positions thereof, only when the moving means of the drive means moves from a first position thereof to a second position thereof the latch member being movable from the non-latching position thereof to a third position thereof by the drive means when the drive means tends to move the latch member from the non-latching position thereof to the latching position thereof when the door means is not in a closed condition thereof, and the moving means of the drive means moves from the first position thereof to the second position thereof the latch member being adapted to actuate the switch means only when the latch member is in the latching position thereof.

Accordingly, it is an object of this invention to provide a new cooking apparatus having one or more of the novel features of this invention as set forth above or hereinafter shown or described.

Another object of this invention is to provide a new method of making a cooking apparatus, the method of this invention having one or more of the novel features of this invention as set forth above or hereinafter shown or described.

Another object of this invention is to provide a new latching construction for a cooking apparatus, the latching construction of this invention having one or more of the novel features of this invention as set forth above or hereinafter shown or described.

Another object of this invention is to provide a new method of making a latching construction for a cooking apparatus, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
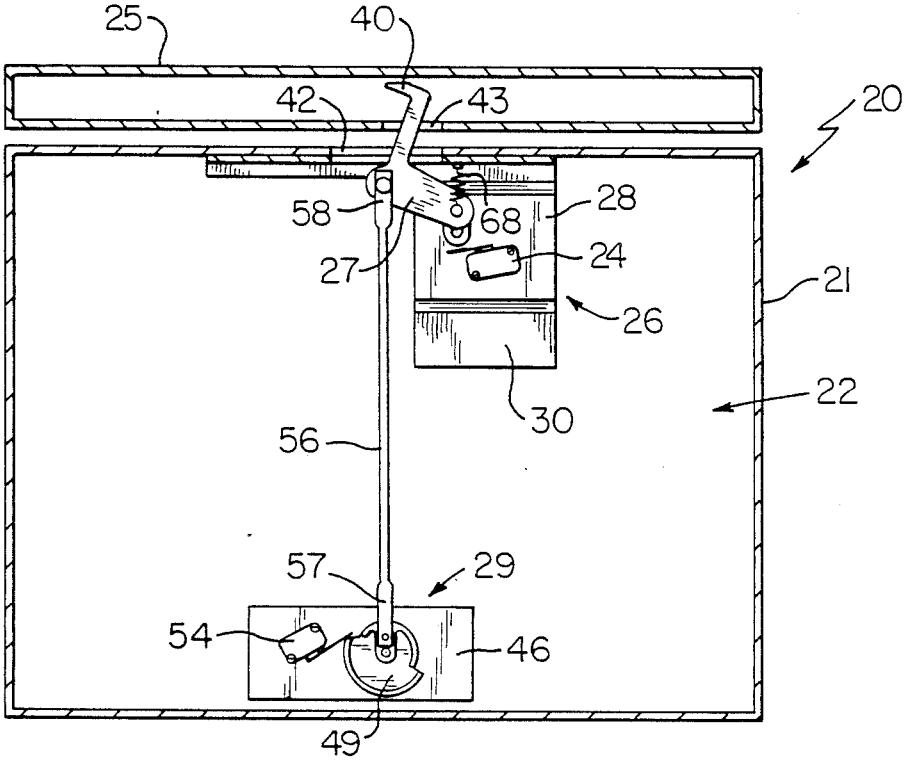
FIG. 1 is a schematic cross-sectional view illustrating the new cooking apparatus of this invention and the new door latching construction of this invention, the door means of the cooking apparatus being in its closed position and the latch member of the latching construction being in its non-latching position.

While the various features of this invention are hereinafter described and illustrated as being particularly adapted to provide a door latching construction for a particular cooking apparatus, it is to be understood that the various features of this invention can be utilized singly or in various combinations thereof to provide a door latching construction for other types of cooking apparatus as desired.

Therefore, this invention is not to be limited to only the embodiments illustrated in the drawings, because the drawings are merely utilized to illustrate one of the wide variety of uses of this invention.

Referring now to FIGS. 1–6, a new cooking apparatus of this invention is generally indicated by the reference numeral 20 and comprises a frame means 21 carrying a cooking chamber means 22 and a heating means 23 (FIGS. 9 and 10) that is adapted to be actuated to heat clean the chamber means 22 in a manner :;ell known in the art.

An electrical switch means 24 is carried by the frame means 21 in a manner hereinafter set forth and permits the heating means 23 to heat clean the chamber means 22 only when the switch means 24 is actuated to a certain condition thereof.

Figure 2:
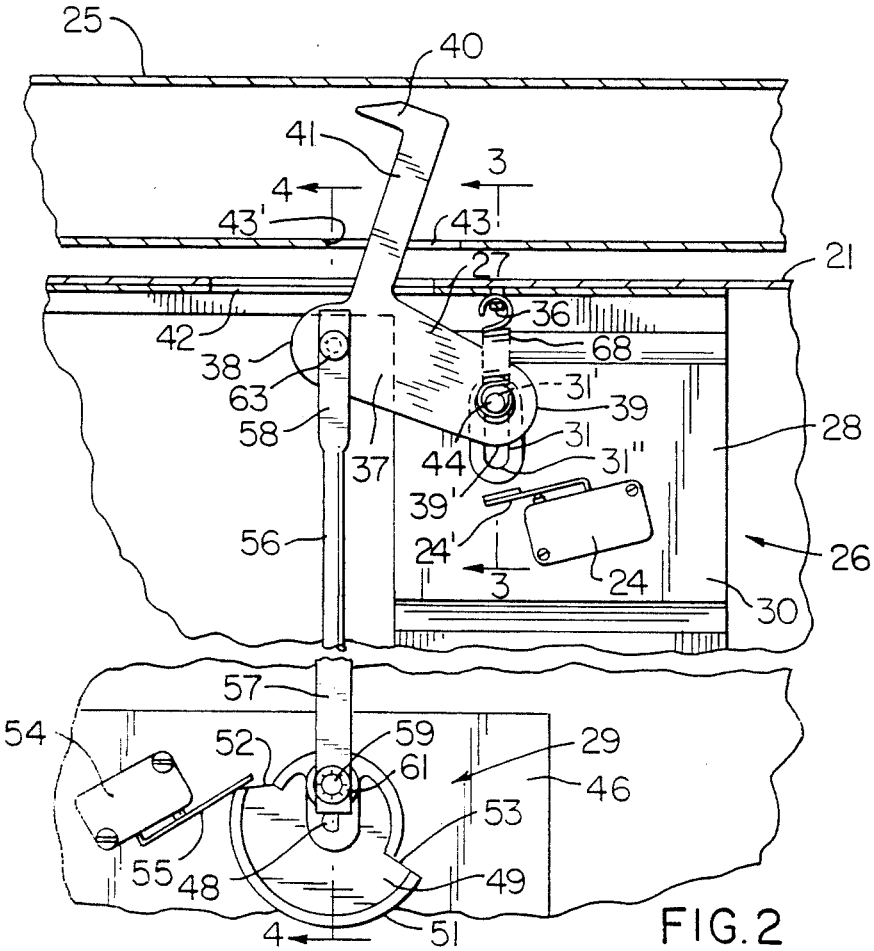
FIG. 2 is an enlarged fragmentary view of the latching structure of FIG. 1.
Figure 5:
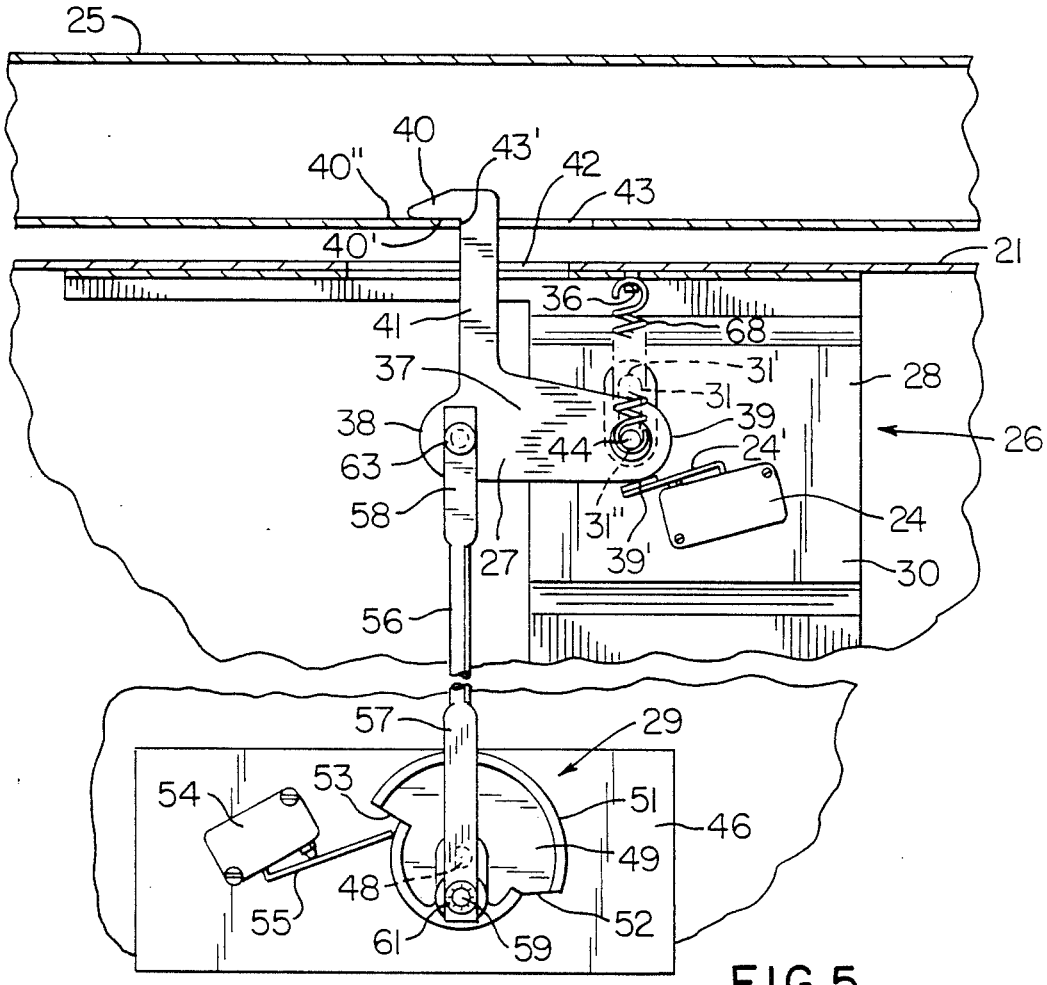
FIG. 5 is a view similar to FIG. 2 and illustrates the latch member moved to its latching position.
Figure 6:
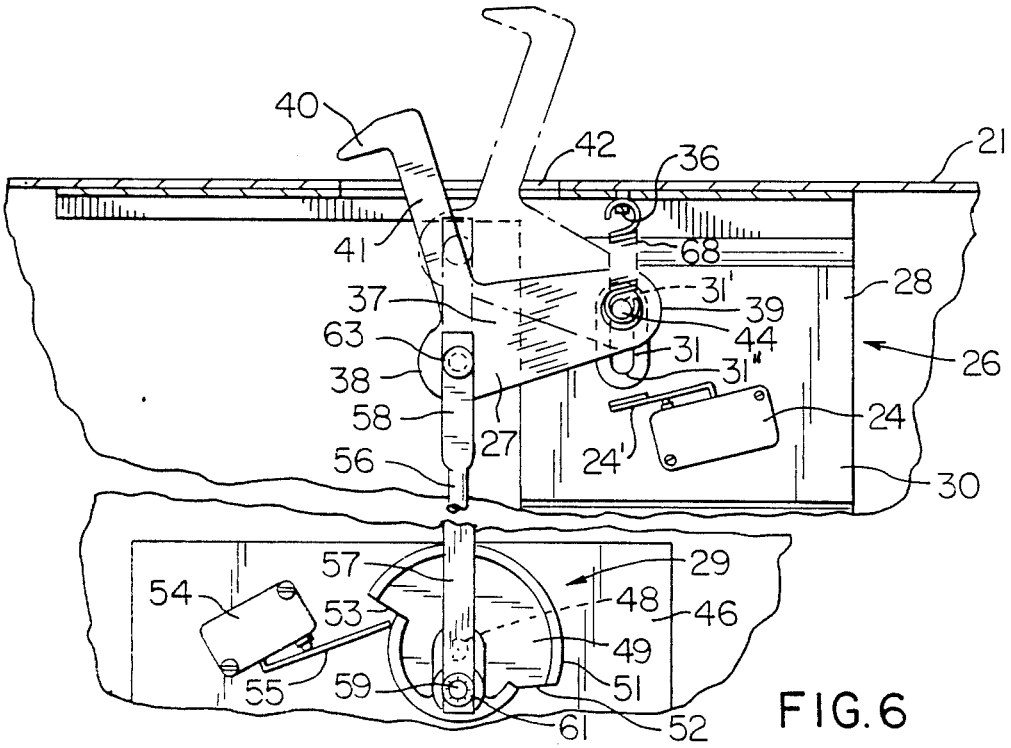
FIG. 6 is a view similar to FIG. 2 but illustrates the movement of the latch member to a third position thereof when the oven door means is in its open position and the drive means for the latch member tends to move the latch member from its non-latching position to its latching position.

The cooking apparatus 20 has a movable door means 25 that is carried by the frame means 21 in a conventional manner for opening and closing the cooking chamber means 22, the door means 25 being shown in its closed condition in FIGS. 1, 2 and 5 and in its open condition in FIG. 6.

A new latching construction of this invention is generally indicated by the reference numeral 26 and is carried by the frame means 21 of the cooking apparatus 20 in a manner hereinafter set forth, the latching construction 26 comprising a movable latch member 27 carried by a frame means 28 that forms part of the frame means 21 of the cooking apparatus by being interconnected thereto. The latch member 27 is operatively interconnected to a drive means 29 and is movable between a non-latching position thereof as illustrated in FIG. 2 that permits the door means 25 to be opened and closed as desired and a latching position thereof as illustrated in FIG. 5 that locks the door means 25 in its closed condition if, at the time the latch member 27 is moved to the latching position thereof by the drive means 29, the door means 25 is in its closed condition as will be apparent hereinafter. However, the latch member 27 is moved from its non-latching position as illustrated by phantom lines in FIG. 6 directly to a third position thereof as illustrated by full lines in FIG. 6 by the drive means 29 when the drive means 29 tends to move the latch member 27 to the latching position thereof when the door means 25 is not in its closed condition thereof as will also be apparent hereinafter.

The latch member 27 and the electrical switch means 24 are so disposed on the frame means 28 of the cooking apparatus 20 that the switch means 24 is only actuated by the latch member 27 when the latch member is moved to its latching position as illustrated in FIG. 5 and is not actuated when the latch member 27 is moved to its third position as illustrated in FIG. 6 as will also be apparent hereinafter.

Figure 3:
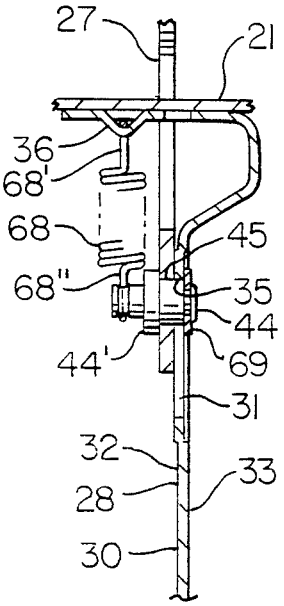
FIG. 3 is a fragmentary cross-sectional view taken on line 3—3 of FIG. 2.

The frame means 28 of the latching construction 26 comprises a plate 30 formed of any suitable material, such as metallic material, and the plate 30 is fastened to the frame means 21 in any suitable manner, such as by spot welding so as to comprise part of the frame means 21 as previously set forth, the plate 30 having an elongated slot means 31 formed through the opposed sides 32 and 33 thereof and has an upper end 35 that is looped and die cut in the manner illustrated in FIG. 3 to define a tang means 36 for a purpose hereinafter set forth, the slot means 31 being substantially straight line and vertically disposed in FIG. 2.

The latch member 27 comprises a one-piece member formed of any suitable material, such as metallic material, and has a main body portion 37 provided with opposed ends 38 and 39 and a hook end 40 extending from the end 38 of the body portion 37 by an arm 41 that is adapted to project out of an opening means 42 formed through the frame means 28, 21 so as to be received in an opening means 43 formed in the side of the door means 25 as illustrated in FIG. 2 when the door means 25 is in the closed condition thereof and the latch member 27 is in the non-latching position thereof.

The end 39 of the body portion 37 of the latch member 27 rotatably carries a pivot pin means 44 that is adapted to slide axially in the slot means 31 of the frame plate 28, the end 39 of the latch member 27 having an opening 45 passing therethrough and loosely receiving the pivot pin 44 therethrough so that the latch member 27 is adapted to rotate on the pivot pin 44 in any of the axial positions of the pivot pin 44 in the slot means 31 of the plate 28 as will be apparent hereinafter.

Figure 4:
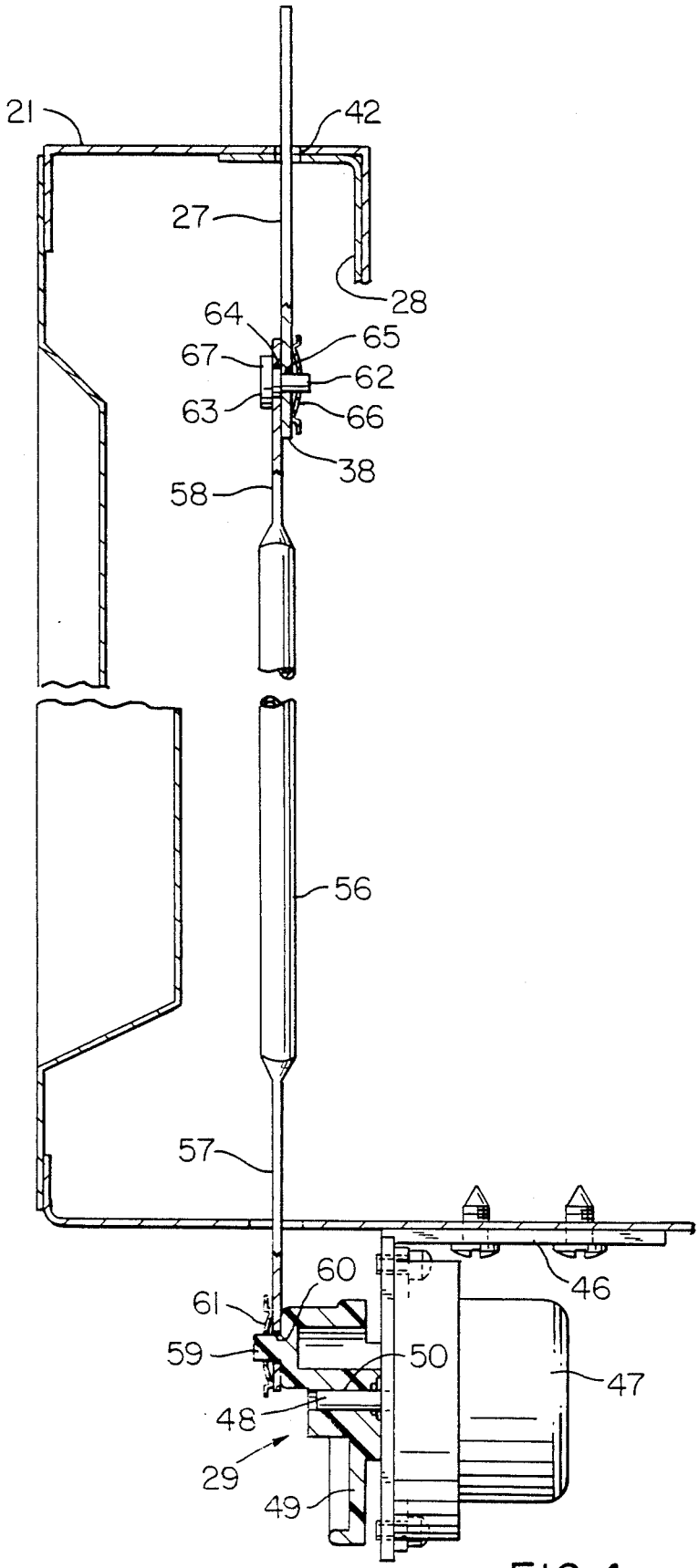
FIG. 4 is an enlarged fragmentary cross-sectional view taken on line 4—4 of FIG. 2.

The drive means 29 of the latching construction 26 is best illustrated in FIG. 4 and includes a mounting bracket 46 for being secured to the frame means 21 of the cooking apparatus 20 in any suitable manner, the mounting bracket 46 carrying an electrically operated motor means 47 that has a rotatable output, D-shaped shaft 48. A plate means 49 is mounted to the output shaft 48 by having a D-shaped opening 50 therein receiving the D-shaped output shaft 48 of the motor 47 so that the plate means 49 will rotate in unison with the output shaft 48.

The plate means 49 has an outwardly extending peripheral cam surface 51 provided with a leading edge 52 and an ending edge 53, the peripheral cam surface 51 being adapted to operate an electrical limit switch 54 being carried by the mounting bracket 46 in such a position that a switch actuator 55 thereof will operate the switch 54 to one condition thereof when the switch actuator 55 is engaged by the peripheral cam surface 51 for a purpose hereinafter set forth. However, the switch actuator 55 operates the switch 54 to another condition thereof when the cam surface 51 is out of engagement with the actuator 55 in a manner well known in the art of limit switches.

The drive means 29 also includes an elongated tubular rod means 56 that has opposed flattened ends 57 and 58 respectively rotatably interconnected to the rotatable plate means 49 and the latch member 27 as illustrated in FIG. 4.

Figure 7:
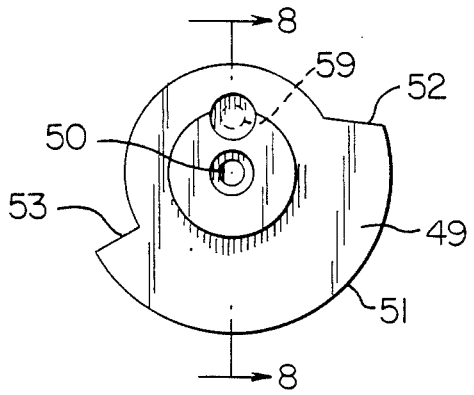
FIG. 7 is an end view of the rotatable plate means of the drive means of the latch construction of FIGS. 1–6.
Figure 8:
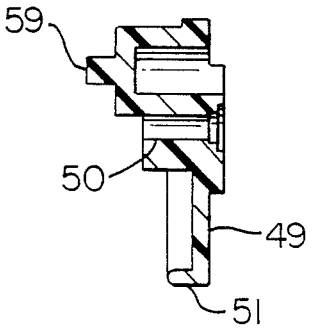
FIG. 8 is a cross-sectional view taken on line 8—8 of FIG. 7.

In particular, the plate means 49 as illustrated in FIGS. 4, 7 and 8 has a cylindrical projection or moving means 59 disposed in offset parallel relation to its shaft opening 50 and is adapted to be received through an opening 60 in the end 57 of the rod means 56 so that the end of the rod means 56 can be fastened thereto by a retaining ring 61 pushed on the end of the projection 59 as illustrated in FIG. 4.

The other end 58 of the rod 56 is rotatably interconnected to the end 38 of the latch member 27 by having a shank portion 62 of a stud 63 pass through an opening 64 in the end 58 of the rod 56 as well as through an opening 65 in the end 38 of the body portion 37 of the latch member 27, the shank portion 62 then receiving a retaining ring 66 on the end thereof so that the end 58 of the rod 56 is rotatably coupled to the latch member 27 by having the end 58 and the latch member 27 trapped between an enlarged head 67 of the stud 63 and the retaining ring 66 as illustrated.

In this manner, as the plate means 49 of the drive means 29 is rotated by the electrical motor 47 in a manner hereinafter set forth, the rod means 56 is adapted to be moved from its upper or first position as illustrated in FIG. 2 to its lower or second position as illustrated in FIGS. 5 and 6 to operate the latch member 27 in a manner hereinafter set forth depending upon whether or not the door means 25 is in a closed or open condition thereof as will be apparent hereinafter.

A tension spring 68 has one end 68′ interconnected to the tang 36 of the mounting plate 28 and its other end 68″ interconnected to the pivot pin 44 so as to always tend to move the pivot pin 44 to the upper end 31′ of the slot 31 as illustrated in FIGS. 2 and 3 but being adapted to be expanded in a manner hereinafter set forth to permit the pivot pin 44 to slide in the slot means 31 to be disposed against the other end 31″ thereof as illustrated in FIG. 5 for a purpose hereinafter set forth.

The switch 24 is mounted to the plate 30 in any suitable manner and has its actuator so arranged relative to a surface 39′ of the latch member 27 that surface 39′ of the latch member 27 only engages the actuator 24′ to operate the switch 24 to a certain condition thereof when the latch member is in the door latching position of FIG. 5 wherein pivot pin 44 is adjacent the end 31″ of the slot 31 as will be apparent hereinafter.

It can be seen in FIG. 3 that the pivot pin 44 not only pivotally mounts the latch member 27 to the frame plate 28, but also the pivot pin 44 maintains the latch member 27 in assembled relation with the frame plate 28 because the latch member 27 is trapped between an enlarged annular flange means 44′ and the side 32 of the frame plate 28 as the pivot pin 44 has a retaining means 69 thereon that is disposed in sliding relation against the other side 33 of the frame plate 28, the retainer 69 being assembled on the pivot pin means 44 after the same has been inserted through the opening 45 in the latch member 27 and the slot means 31 in the frame plate 28 as illustrated in FIG. 3.

Figure 10:
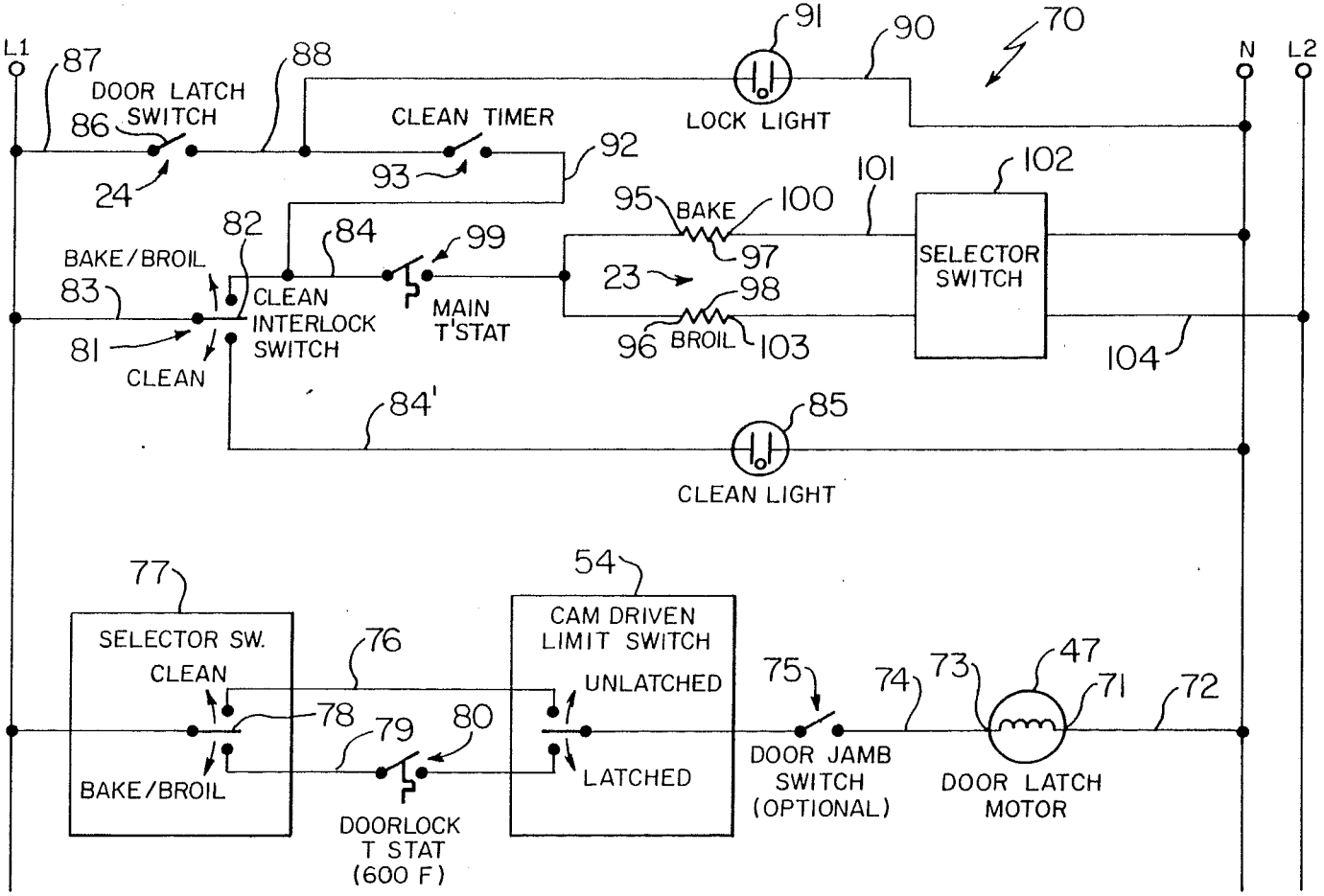
FIG. 10 is an electrical diagram illustrating another electrical system means for controlling the cooking apparatus of FIG. 1.

While any suitable electrical circuit or system for controlling the cooking apparatus 20 utilizing the latching construction 26 of this invention can be designed to operate with the latch construction 26 of this invention, one such electrical system is generally indicated by the reference numeral 70 in FIG. 10 and comprises an electrical power source defined by three main leads L1, L2 and N.

The door latch motor 47 has one side 71 thereof interconnected to the power lead N by a lead 72 and the other side 73 thereof interconnected to the limit switch 54 by a lead 74, the lead 74 having a door jamb switch 75 therein, if desired, which will only be closed if the door 26 is in its closed condition as in a conventional manner. However, in the particular system 70 of this invention, the door jamb switch 75 can be eliminated, if desired, as will be apparent hereinafter.

When the limit switch 54 has the actuator 55 thereof engaging the peripheral cam means 51 of the rotatable plate 49 of the motor means 47 so that the actuator 55 is operating the switch 54 to be in a certain condition thereof, that certain condition of the switch 54 in the circuit 70 interconnects the lead 74 to a lead 76 that leads to a selector switch 77 wherein a movable member 78 of the selector switch 77 will interconnect the power source lead L1 to the lead 76 if the selector switch 77 is disposed in a "clean" mode thereof and will disconnect the lead L1 from the lead 76 and place the same in electrical contact with a lead 79 when the selector switch 77 is disposed in a "bake/broil" mode thereof. The lead 79, in turn, is adapted to be interconnected by the limit switch 54 to the lead 74 only when the limit switch 54 has its actuator 55 out of engagement with the peripheral cam surface 51 of the rotatable plate means 49 of the door latch motor 47 as will be apparent hereinafter. The lead 79 has a thermostatically controlled switch means 80 therein which closes the line 79 only when the sensed temperature in the cooking chamber means 22 is below 600° F. so that when the temperature in the chamber 22 is above 600° F., such as during an oven heat cleaning cycle, the switch means 80 is maintained in an open condition thereof for a purpose hereinafter set forth.

The electrical system 70 has another selector switch 81 therein which has its movable member 82 interconnected by a lead 83 to the power source lead L1 and is adapted to interconnect the lead 83 to a lead means 84 when the selector means 81 is set in a "bake/broil" mode thereof and to disconnect the lead 83 from the lead 84 when the movable member 82 thereof is disposed in the "clean" mode thereof, which position of the member 82 interconnects the lead 83 to a lead 84' which is interconnected to the power source lead N and has a light means 85 therein and which, when actuated, indicates that a cleaning cycle is to take place.

The door latch switch 24 has a movable member 86 interconnected by a lead 87 to the power source lead L1 and is adapted to interconnect the lead 87 to a lead 88 when the movable member 86 is disposed in an actuated position thereof as caused by the latch member 27 being disposed in its latching position as illustrated in FIG. 5 wherein the end 39 of the body portion 37 of the latch member 27 has the surface 39' thereof engaging against the actuator 24' of the switch 24 to hold the same in the actuated condition illustrated in FIG. 5 and thereby closing the member 86 so as to interconnect the leads 87 and 88.

The lead 88 is interconnected to the power source lead N by a lead 90 that has a lock light 91 therein which will be illuminated when the door latch switch 24 is in the closed or actuated condition thereof.

The lead 88 is also interconnected by a lead 92 to the lead 84, the lead 92 having a clean timer switch means 93 therein so that the lead 88 will only be interconnected to the lead 84 by the lead means 92 when the timer for a cleaning cycle is operating in a manner well known in the art.

The lead 84 is interconnected to a lead 94 that respectively leads to the sides 95 and 96 of the bake element 97 and broil element 98 of the heating unit 23 as illustrated, the lead 84 having a switch means 99 therein which is operated by the main thermostatic device (not shown) of the cooking apparatus 20 so that when the main thermostat switch 99 is set for a selected temperature, the switch means 99 will open when such selected set temperature in the cooking chamber 22 is reached and will cause the switch 99 to close when the temperature in the cooking chamber 22 falls below the selected temperature in a manner well known in the art.

The other side 100 of the bake element 97 is interconnected by a lead 101 to the power source lead N if a selector switch 102 is set in a "bake" mode or a "clean" mode thereof. Similarly, the side 103 of the broil element 98 is interconnected by a lead 104 to the power source lead L2 if the selector switch 102 is set in a "broil" mode or a "clean" mode thereof.

From the above, it can be seen that the cooking apparatus 20 and latching construction 26 therefor as well as the electrical system 70 can be formed in a relatively simple manner by the method of this invention from the parts previously set forth so as to operate in a manner now to be described.

With the latch member 27 disposed in the non-latching position illustrated in FIG. 2 wherein the tension spring 68 is maintaining the pivot pin means 44 against the end 31' of the slot means 31 and the rotatable plate means 49 of the door latch motor 47 is in the position where the peripheral cam means 51 thereof is causing the limit switch 54 to be in the condition wherein the lead 74 is interconnected to the lead 76 in FIG. 10 and the rod means 56 is in its up position so that the latch member is in its non-latching position, the oven door means 25 can be moved from its open to its closed position as the hook end 40 of the latch member 27 permits the opening 43 in the door 25 to freely move over the same whereby the oven 22 can be utilized for normal cooking operations with the heating unit 23 in a manner well known in the art and need not be described.

However, when a person desires to heat clean the oven 22 by a burnoff operation with the heating unit 23, that person must operate the system 70 so that the selector switches 77, 81 and 102 are respectively disposed in the "clean" mode thereof, the selector switch 81 in the "clean" mode thereof merely causing the clean light 85 to be energized and requiring the heating unit 23 to be only operated if the door latch switch 24 is in a closed condition which, as previously set forth, can only take place if the latch member 27 is moved to its latching position as illustrated in FIG. 5.

However, before the latch member 27 can be moved to its latching position, the motor 47 must be operated to pull downwardly on the rod means 56 and this is accomplished by the selector switch 77 being disposed in the "clean" mode thereof so that the movable member 78 thereof interconnects the power source lead L1 with the lead 76 which is interconnected to the lead 74 because the limit switch 54 is in the unlatched condition thereof as the actuator 55 thereof is against the end 52 of the peripheral cam surface 51 so that the door latch motor 47 will now be operated by being placed across the power source leads L1 and N and begin to rotate the plate means 49 in a clockwise direction in FIG. 2 to the position illustrated in FIG. 5 if the oven door 25 is in a closed condition. If the oven door 25 is in a closed condition, the movement of the rotatable plate 49 in a clockwise direction in FIG. 2 initially pulls downwardly on the rod 56 to cause the latch member 27 to rotate on the pivot pin 44 while the pivot pin 44 is being maintained against the upper end 31' of the slot 31 by the tension spring 68 so that the latch member 27 merely rotates in a counterclockwise direction on the pivot pin 44 whereby the arm 41 of the latch member moves to the left. If the oven door 25 is in its closed condition during this time, the arm 41 will eventually hit against the edge 43' of the oven door 25 that is defined by the left end of the opening 43 thereof which prevents further counterclockwise rotation of the latch member 27 on the pivot pin 44 to its third position of FIG. 6. However, since the rod 56 is still being moved downwardly by the operating door latch motor 47, the latch member 27 now moves vertically downwardly therewith and pulls the pivot pin 44 downwardly therewith in the slot means 31 in opposition to the force of the tension spring 68 so that by the time the rod means 56 is in the lowermost position as illustrated in FIG. 5, the hook end 40 of the latch member 27 now has its latching edge 40' engaging against or disposed relatively close to the inside surface 40" of the door means 25 so as to prevent the door means 25 from being moved from its closed position. At the time that the latch member 27 has been moved to its latching position as illustrated in FIG. 5 wherein the pivot pin means 44 is now adjacent the lower end 31" of the slot means 31, the surface 39' of the latch member 27 is now bearing against the actuator 24' of the door latch switch 24 to actuate the same and thereby close the movable member 86 thereof in FIG. 10 so as to interconnect the lead 87 to the lead 88 and thus interconnect the power source lead L1 through the closed clean timer switch 93 and the closed main thermostat switch 99 to one side of the heating unit 23 which now has its other side interconnected to the power source leads N and L2 by the selector switch 102 which has been set in its "clean" mode as previously set forth. Also, at this same time that the rod 56 has been moved downwardly to the latched position of FIG. 5 by the motor 47, the end 53 of the cam means 51 on the rotatable plate means 49 of the door lock motor 47 has now moved away from the actuator 55 of the limit switch 54 so that the limit switch 54 is now in the "latched" position thereof and thereby disconnects the lead 76 from the lead 74 to turn off the motor 47 so that the motor 47 now maintains the latch member 27 in the latched condition as illustrated in FIG. 4.

Thus, the latch member 27 cannot be moved to its non-latching condition until the door latch motor 47 is again energized and this can only take place when the selector switch 77 is changed from its "clean" mode to its "bake/broil" mode thereof to cause the movable member 78 thereof to be disposed in the "bake/broil" position thereof in FIG. 10 and thereby interconnect the power source lead L1 to the lead 79 and, thus, to the door latch motor 47 whenever the thermostatically operated switch 80 is in a closed condition thereof. Such closed condition of the switch 80 only takes place when the temperature in the oven 22 has fallen to below 600° F. so that once the cleaning operation has started and the temperature in the oven 22 is above 600° F., the motor 47 cannot be operated to move the latch member 27 to its non-latching position for reasons well known in the art and it is well known that the temperature in the oven 22 will not fall below 600° F. after the same has been operating in its clean cycle until the electrical current to the heating unit 23 is terminated. Such termination of electrical current to the heating unit 23 will occur when the clean timer switch 93 has been moved to an open condition thereof by the conventional timer means having operated the cleaning cycle for the selected cleaning time in a manner well known in the art.

Assuming that after the cooking chamber means 22 has been cleaned by the circuit means 70 having operated the heating unit 23 in the manner previously described so that the clean timer switch 93 now moves to an open condition to disconnect the heating unit 23 from being interconnected across the power source leads L1 and N, L2, and assuming that the temperature in the cooking chamber means 22 has now fallen to a temperature that is below approximately 600° F. so that the door lock thermostatically operated switch 80 is now in a closed condition thereof, the operator can unlock the oven door 25 by causing the selector switch 77 to be disposed out of its "clean" mode and into its "bake/broil" mode and since the limit switch 54 has its operator 55 out of engagement with the cam surface 51 of the rotatable plate 49 of the drive means 29 so that the lead 79 is interconnected by the limit switch 54 to the lead 74, the door latch motor 47 will again be energized as the same is placed across the power source leads L1 and N and thereby rotates the plate means 49 in a clockwise direction in FIG. 5 to raise the rod means 56 and cause the arm 41 of the latch member 27 to slide upwardly on the edge 43' of the oven door 25 and carry the pivot pin means 44 therewith until the pivot pin means 44 engages against the upper end 31' of the slot 31 whereby further upward movement of the rod means 56 by the operating motor means 47 causes the latch member 27 to now rotate in a clockwise direction on the pivot pin means 44 and move away from the edge 43' of the door 25 into the non-latching position of FIG. 2. At this time, the leading edge 52 of the cam surface 51 now comes into engagement with the actuator 55 of the limit switch 54 and operates the same from its "latched" position of FIG. 10 to its "unlatched" position of FIG. 10 to disconnect the motor 47 from across the power source leads L1 and N so that the deenergized motor 47 now holds the latch member 27 in its non-latching position to permit the operator to open and close the oven door 25 as desired.

As the latch member 27 was being moved upwardly from its latching condition of FIG. 5 by the upwardly moving rod means 56, the surface 39' of the latch member 27 now moves away from the actuator 24' of the switch 24 so that the switch 24 is now operated to the position thereof whereby the movable member 86 of the switch 24 of FIG. 10 is held in its open condition and thereby will prevent any electrical current to pass to the heating unit 23 even though the selector means 81 and 102 may be disposed in the "clean" mode thereof.

The previous operation of the cooking apparatus 20 took place during the initiation of the cleaning cycle on the basis that the oven door 25 was in a closed condition thereof.

However, if the oven door 25 had been in an open condition thereof upon the initiation of the cleaning cycle as previously described, the arm 41 of the latch member 27 would not have engaged against the edge 43' of the oven door 25 as the same was being moved from its non-latching position in a counterclockwise direction about the pivot pin means 44 by the operating motor 47 so that the latch member 27 would have continued to rotate in a counterclockwise direction to the third position thereof as illustrated in FIG. 6 wherein the rod means 56 has been moved vertically downwardly to its lowest position where the cam means 51 of the plate means 49 now operates the limit switch 54 to its "latched" position of FIG. 10 to discontinue the energization of the motor 47 as previously set forth. However, at this time, since the latch member 27 was permitted to move to the third position thereof as illustrated in FIG. 6, the latch member 27 never pulled the pivot pin 44 downwardly in the slot means 31 so that the door latch switch 24 was never operated by the latch member 27 and thus, the heating unit 23 cannot be operated in the "clean" mode setting of the system 70 as the movable member 86 of the switch means 24 remains in the open condition as illustrated in FIG. 10.

Therefore, it can be seen that the latch member 27 senses whether the oven door 25 is in a closed position thereof when an attempt is being made to move the latch member 27 from its non-latching position to its latching position and if the oven door 25 is in a closed condition thereof, the latch member 27 is then permitted to move to its latching position and actuate the door latch switch 24 which must be actuated before the heating unit 23 can be operated in a cleaning mode thereof.

Thus, it can be seen that during an attempt to have the latch member 27 be moved from its non-latching position of FIG. 2 to the latching position thereof as illustrated in FIG. 5, the initially energized door lock motor 47 causes the latch member 27 to rotate on the pivot pin means 44, while the pivot pin means 44 is held in its up condition against the end 31' of the slot 31 by the tension spring 68, from the non-latching position of FIG. 2 all the way to the third position of FIG. 6 except that if the oven door 25 is in its closed condition at this time, the rotating latch member 27 is interrupted in its rotational movement at a point intermediate the non-latching position thereof and the third position thereof by the edge means 43' of the closed door means 25 so that the downwardly moving rod means 56 now causes the latch member 27 to move substantially in a linear manner from such intermediate position to the latching position in opposition to the force of the tension spring 68 as illustrated in FIG. 5 for the reasons previously set forth.

While the door latch member 27 has the surface 39' thereof operating the actuator 24' of the switch 24 as the latch member 27 is being moved to its latching position, it is to be understood that the switch 24 could be so constructed and arranged that the same will only be actuated to permit the heating unit 23 to be energized in a cleaning operation only when the latch member 27 is moved out of engagement with the actuator 24' thereof.

Figure 11:
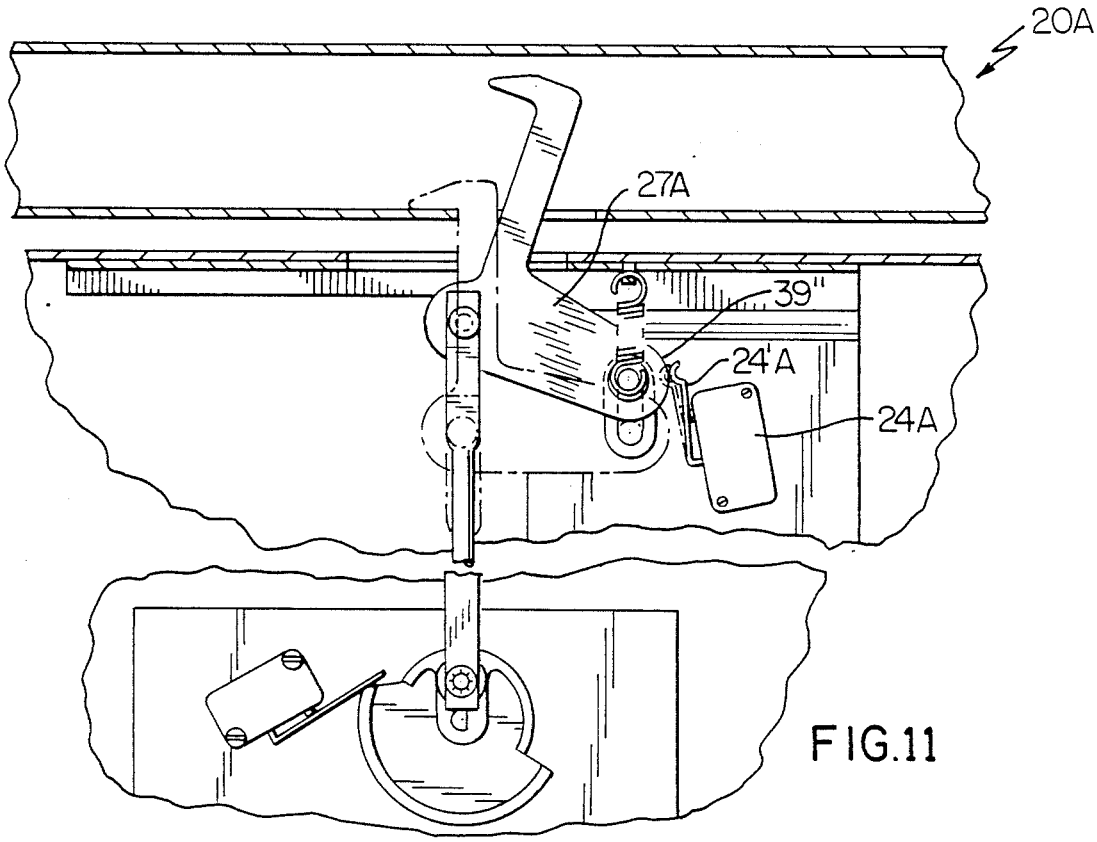
FIG. 11 is a view similar to FIG. 2 and illustrates another embodiment of this invention.

For example, reference is now made to FIG. 11 wherein another cooking apparatus of this invention is generally indicated by the reference numeral 20A and the parts thereof that are similar to parts of the cooking apparatus 20 previously described are indicated by like reference numerals followed by the reference letter "A".

As illustrated in FIG. 11, the switch 24A has the actuator 24'A thereof arranged to be operated by an upper surface 39" of the latch member 27A so that the surface 39" must be moved away from the actuator 24'A when the latch member 27A is moved to its latching position as illustrated by phantom lines in FIG. 11 and thereby permit the switch means 24A to move the actuator 86 of FIG. 10 to its closed position.

Also, it may be found that it is desired to provide means to permit a serviceman to manually unlock the latch member from its locked position should the electrical system for the cooking apparatus fail while the latch member is in its latching position and is locking the oven door in its closed position.

Figure 12:
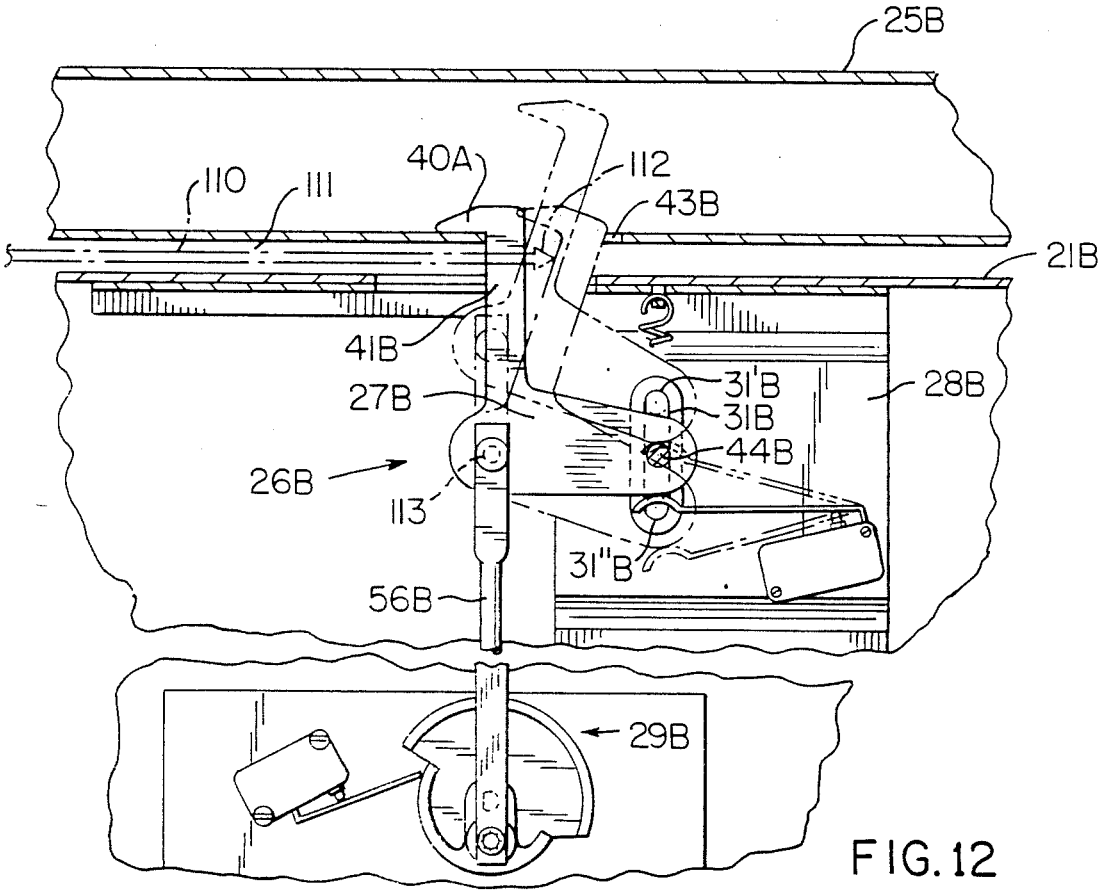
FIG. 12 is a view similar to FIG. 11 and illustrates another embodiment of this invention.
Figure 13:
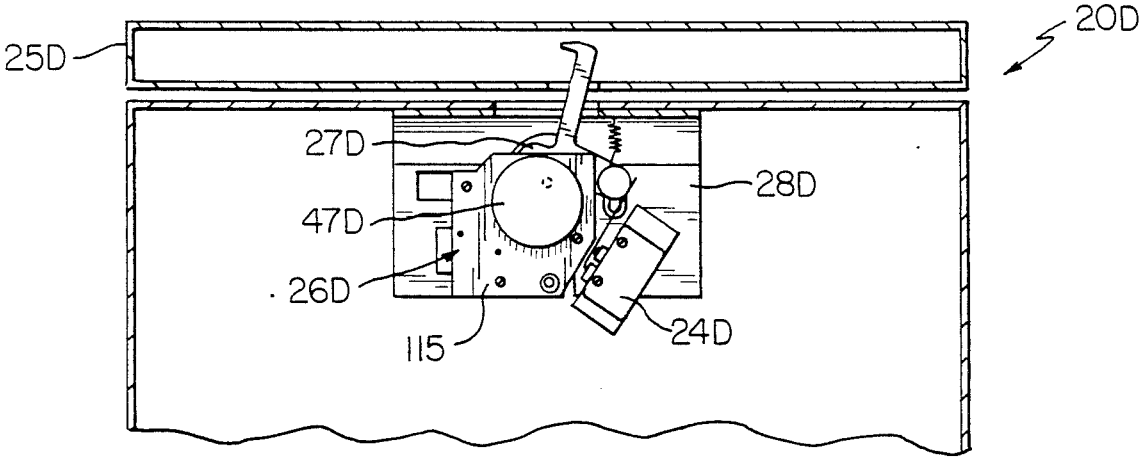
FIG. 13 is a fragmentary view similar to FIG. 1 and illustrates another embodiment of this invention.

In particular, another cooking apparatus of this invention is generally indicated by the reference numeral 20B in FIG. 12 and parts thereof similar to the cooking apparatus 20 previously described are indicated by like reference numerals followed by the reference letter "B".

As illustrated in FIG. 12, the latching construction 26B of the cooking apparatus 20B is substantially identical to the latching structure 26 previously described except that the elongated slot 31B in the frame means 28B is longer toward the end 31"B thereof so that when the drive means 29B has moved the latching member 27B from its non-latching position as illustrated by the upper phantom lines in FIG. 12 to its latching position as illustrated by full lines in FIG. 12, the pivot pin means 44B is at a point intermediate the opposed ends 31'B and 31"B of the slot means 31B. This latching position of the latch member 27B can be manually unlatched by the serviceman inserting a suitable tool 110 into the space 111 between the door 25B and the frame 21B to engage against the arm 41B of the latch member 27B to be moved in the direction of the arrowhead 112 in FIG. 12 whereby the latch member 27B will be rotated in a clockwise direction about the fixed point 113 at the upper end of the rod means 56B and cause the pivot pin 44B to now slide further downwardly in the slot means 31B toward the end 31"B thereof and thereby permit the latch member 27B to be rotated to the lower phantom line position thereof in FIG. 12 which clears the hook end 40B of the latch member from its latching position to a position that permits the door means 25B to pull the opening 43B thereof over the hook end 40B of the latch member 27B and thereby open the door means 25B.

While the electrical circuit 70 of FIG. 10 has been previously described as not utilizing a microprocessor, it is to be understood that the electrical system for the cooking apparatus of this invention can utilize a microprocessor if desired.

Figure 9:
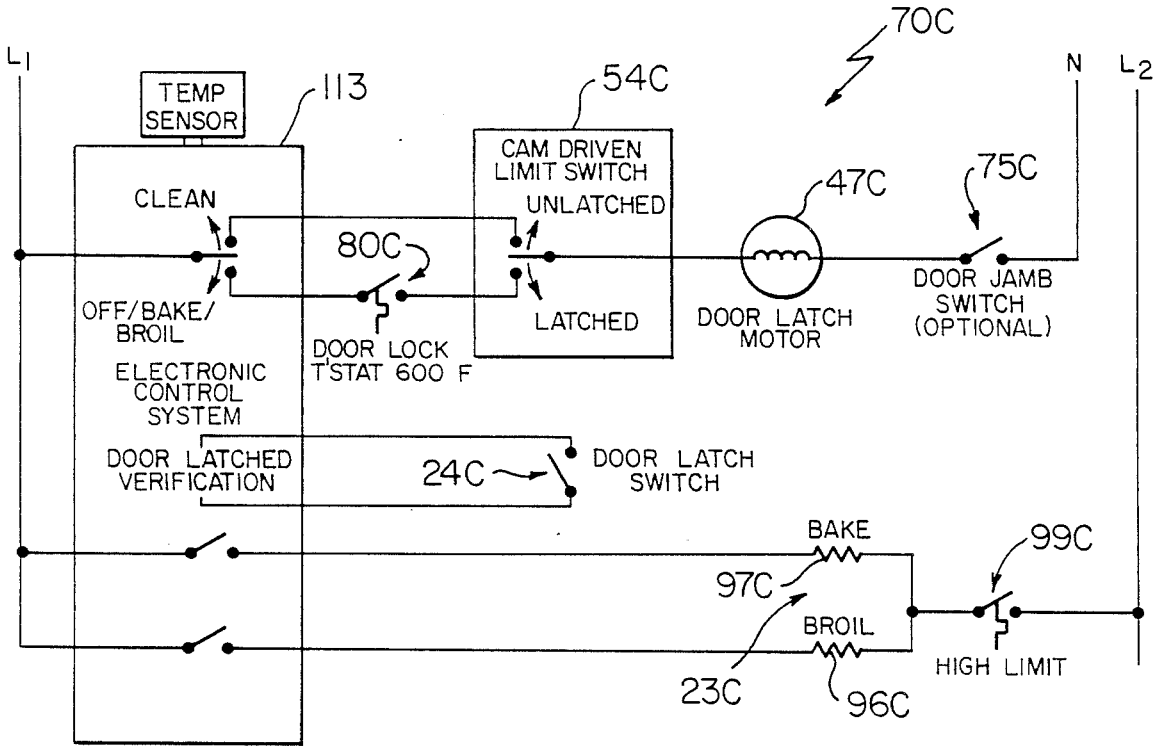
FIG. 9 is an electrical diagram illustrating one electrical system means for controlling the cooking apparatus of FIG. 1.

In particular, reference is now made to FIG. 9 wherein another electrical system of this invention is generally indicated by the reference numeral 70C and parts thereof similar to the system 70 previously described are indicated by like reference numerals followed by the reference letter "C".

It can be seen that the system 70C of FIG. 9 has a microprocessor 113 which will operate the system 70C in the same manner as the system 70 of FIG. 10 and, therefore, a further discussion thereof is deemed not necessary as a person skilled in the electronic art will fully understand how the system 70C is to have the microprocessor 113 programmed to operate its cooking apparatus in the same manner that the circuit 70 operates its cooking apparatus 20 as previously described.

While the drive means 29 previously described has the electrical motor means 47 disposed remote from the latch member 27 and being interconnected thereto by the elongated rod means 56 as previously described, the drive motor and its rotatable plate could be mounted on the same frame plate that carries the latch member and be directly and uniquely interconnected thereto to operate the latch member thereof in substantially the same manner as the latch member 27 as previously described.

For example, another cooking apparatus of this invention is generally indicated by the reference numeral 20D in FIGS. 13–17 and parts thereof similar to the cooking apparatus 20 previously described are indicated by the like reference numerals followed by the reference letter "D".

As illustrated in FIGS. 13–17, it can be seen that the latch member 27D is pivotally mounted to the frame plate 28D by the pivot pin means 44D in the same manner as previously set forth as the plate means 28D has the slot means 31D therein for receiving the pivot pin means 44D as previously set forth.

Figure 15:
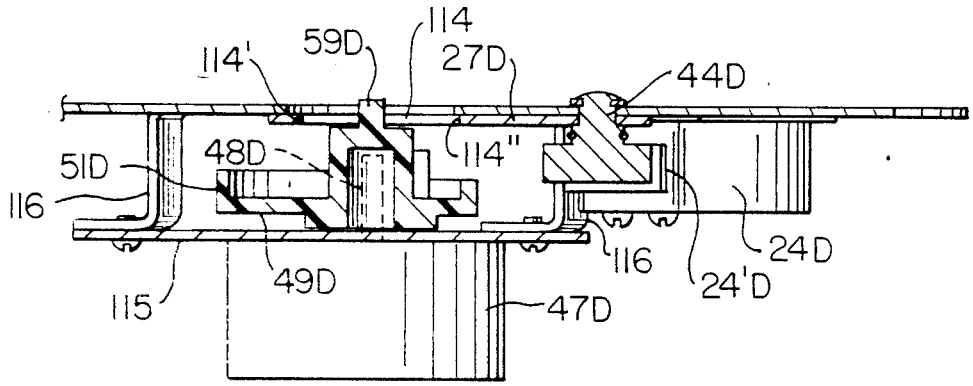
FIG. 15 is a fragmentary cross-sectional view taken on line 15—15 of FIG. 14.

However, the latch member 27D has an elongated slot means 114 formed therethrough and receiving the projection 59D of the rotatable plate means 49D that is carried on the output shaft 48D of the door lock motor 47D which is mounted to a plate 115 that is fastened to the plate 28D by spacers 116 as illustrated in FIG. 15.

In addition, the limit switch 54D is mounted to the plate 28D in such a position that its actuator 55D will be operated by the cam means 51D of the rotatable plate 49D in the manner previously described.

Similarly, the switch 24D is secured to the plate 28D so that its operator 24'D will be operated by the surface 39'D of the latch member 27D in the manner previously set forth.

Therefore, it can be seen that the latching construction 26D for the cooking apparatus 20D has the drive means 29D thereof carried by the same frame plate 28D that carries the latch member 27D that is operated thereby in a manner now to be described.

Figure 14:
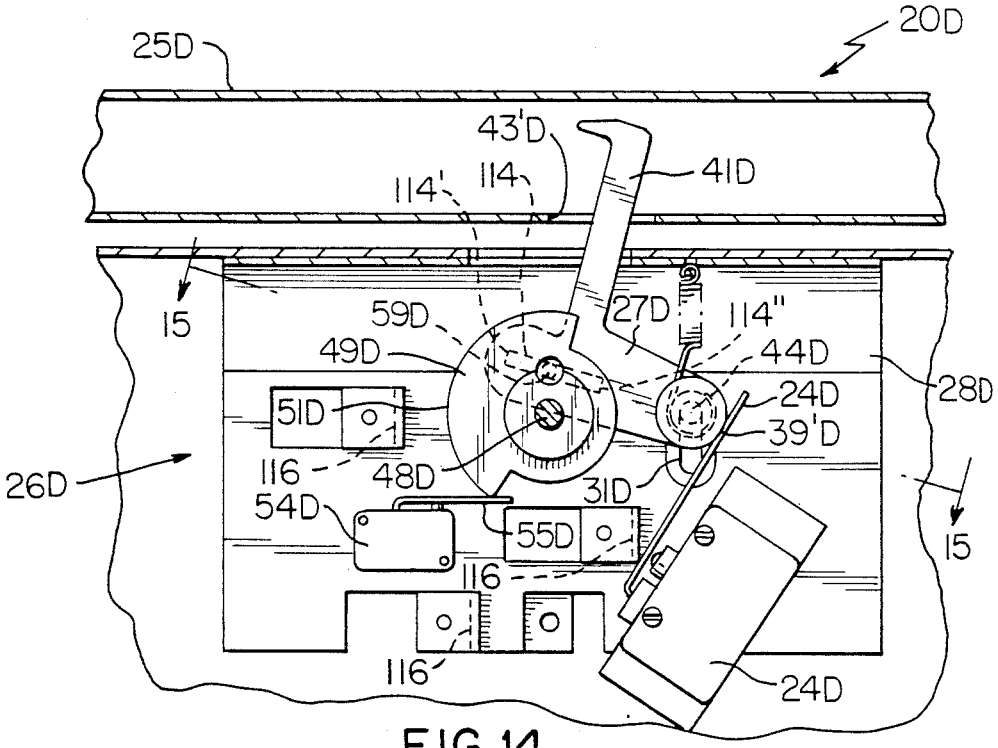
FIG. 14 is an enlarged fragmentary view of the latching structure of FIG. 13 with the drive motor means and the mounting plate therefor removed.

With the latch member 27D disposed in the non-latching position as illustrated in FIG. 14, it can be seen that the projection 59D of the plate means 49D is disposed in the slot 114 of the latch member 27D intermediate its opposed ends 114' and 114" so as to permit relative movement therebetween.

In particular, when the motor 47D is energized to begin a door locking operation, and with the door 25D being in the closed condition as illustrated in FIG. 14, the door lock motor 47D rotates the plate means 49D in a counterclockwise direction in FIG. 14 and such rotation of the plate 49D causes the projection 59D thereof to move in the slot 114 toward the end 114' thereof and thereby cause the latch member 27D to rotate in a counterclockwise direction on the pivot pin means 44D until the arm 41D engages against the edge 43'D of the oven door 25D so that further rotation of the latch member 27D is prevented. However, since the timer motor 47D is continuing to rotate the plate 49D in a counterclockwise direction, such operation of the projection 59D in the slot 114 of the latch member 27D now pulls the latch member 27D in a straight line manner downwardly to its latching position as illustrated in FIG. 16 at which position the latch member 27D is operating the switch 24D and has moved the cam surface 51D of the plate 49D out of engagement with the actuator 55D of the limit switch 54D for the reasons previously set forth whereby the oven door 25D is locked in its closed condition.

Figure 16:
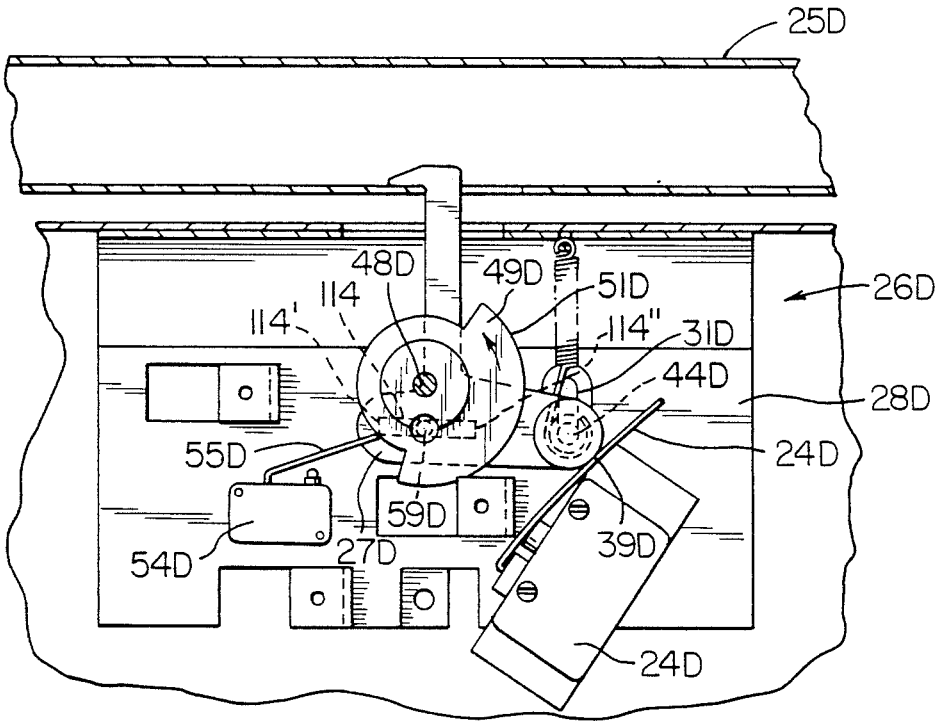
FIG. 16 is a view similar to FIG. 14 and illustrates the latch member in its latching position.
Figure 17:
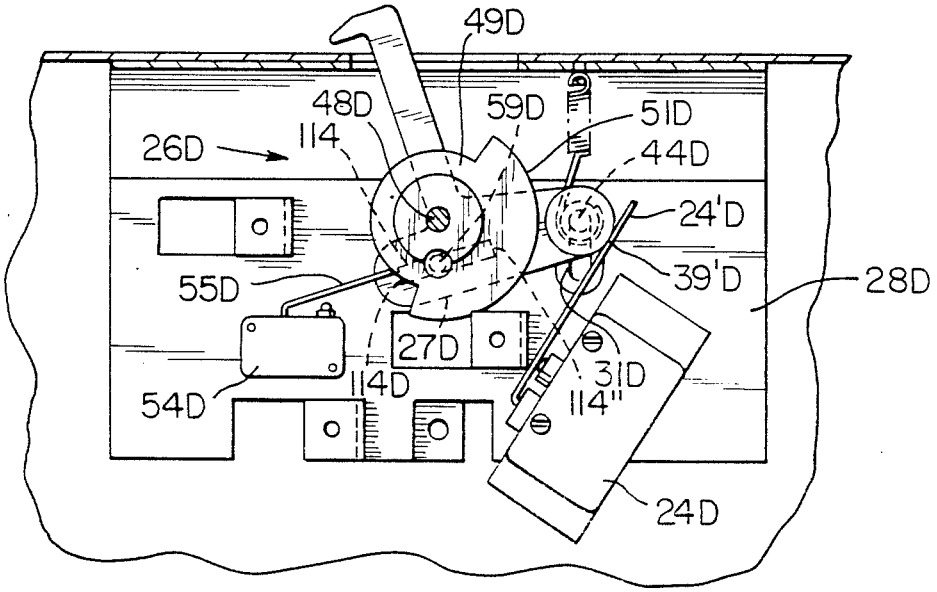
FIG. 17 is a view similar to FIG. 16 and illustrates the latch member moved to its third position when the oven door means is in its open position and the drive means tends to move the latch member from its non-latching position to its latching position.

However, should the oven door 25D have been in its open condition during such operation of the latch member 27D, it can be seen that the latch member 27D would have continued to rotate in the counterclockwise direction from its non-latching position of FIG. 14 to its third position of FIG. 17 without requiring the pivot pin means 44D to have moved downwardly in the slot 31D for the reasons previously set forth so that when the projection 59D of the plate 49D is in the down position as illustrated in FIG. 16, the limit switch 54D now turns off the timer motor 47D and the electrical switch 24D has not been operated so that a heat cleaning operation cannot take place in the oven 20D for the reasons previously set forth in connection with the cooking apparatus 20.

Since the operation of the latch member 27D to be moved back from its latching position to its non-latching position is the same as previously described for the cooking apparatus 20, a further discussion of the operation of the latch member 27D is deemed unnecessary.

However, it can be seen that by arranging the slot 114 in the latch member 27D and disposing the projection 59D of the rotatable plate 49D therein, the movement of the latch member 27D is substantially identical to the movement of the latch member 27 previously set forth even though the rod means 56 is utilized between the plate 49 and the latch member 27.

Therefore, it can be seen that this invention not only provides new cooking apparatus and new door latching constructions therefor, but also this invention provides new methods of making the same.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a cooking apparatus comprising a frame means, a cooking chamber means carried by said frame means, heating means carried by said frame means and being adapted to be actuated to heat clean said chamber means, switch means for permitting said heating means to heat clean said chamber means only when said switch means is actuated, a movable door means carried by said frame means for opening and closing said cooking chamber means, a movable latch member carried by said frame means and being movable between a non-latching position thereof that permits said door means to be opened and closed and a latching position thereof that locks said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, the improvement wherein said latch member is movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof, said latch member being adapted to actuate said switch means only when said latch member is in said latching position thereof.

2. A cooking apparatus as set forth in claim 1 wherein said latch member has a pivot pin means that is operatively interconnected to said frame means so that said latch member is adapted to be rotated relative to said frame means by said drive means.

3. A cooking apparatus as set forth in claim 2 wherein said frame means has means that is operatively interconnected to said pin means of said latch member to permit said latch member to be rotated relative thereto.

4. A cooking apparatus as set forth in claim 3 wherein said means of said frame means causes said latch member to be rotated from said non-latching position thereof to said third position thereof by said drive means when said door means is not in said closed condition thereof.

5. A cooking apparatus as set forth in claim 4 wherein said means of said frame means causes said latch member to be rotated by said drive means from said non-latching position thereof to a position intermediate said third position thereof and said non-latching position thereof when said door means is in said closed condition thereof and then move said latch member from said intermediate position thereof to said latching position thereof.

6. A cooking apparatus as set forth in claim 5 wherein the movement of said latch member from said intermediate position thereof to said latching position thereof is substantially a straight line movement thereof.

7. A cooking apparatus as set forth in claim 6 wherein said means of said frame means comprises an elongated slot means in said frame means that receives said pivot pin means therein, said slot means having opposed ends, and spring means operatively interconnected to said latch member and to said frame means to tend to maintain said pivot pin means against one of said ends of said slot means.

8. A cooking apparatus as set forth in claim 7 wherein said latching position of said latch member causes said pivot pin means thereof to be disposed intermediate said opposed ends of said slot means.

9. A cooking apparatus as set forth in claim 7 wherein said latching position of said latch member causes said pivot pin means thereof to be disposed adjacent the other of said ends of said slot means.

10. A cooking apparatus as set forth in claim 1 wherein said drive means comprises a motor means carried by said frame means and having a rotatable output shaft means, a plate means carried by said shaft means to rotate in unison therewith, and means carried by said plate means in offset relation to said shaft means and being operatively interconnected to said latch member to move said latch member in relation to rotation of said plate means by said motor means.

11. A cooking apparatus as set forth in claim 10 wherein said means carried by said plate means comprises an elongated rod means having opposed ends respectively rotatably interconnected to said plate means and to said latch member.

12. A cooking apparatus as set forth in claim 10 wherein said means carried by said plate means comprises a projection means extending therefrom in spaced parallel relation to said output shaft means, said latch member having an elongated slot means therein, said projection means extending into said slot means of said latch member and being movable therein.

13. In a latching construction for a cooking apparatus having a cooking chamber means and a movable door means for opening and closing said cooking chamber means, said latch construction comprising a frame means, a movable latch member carried by said frame means and being movable between a non-latching position thereof that would permit said door means to be opened and closed and a latching position thereof that would lock said door means in its closed position if said door means is in its closed position at the time said latch member is moved to said latching position thereof, and drive means carried by said frame means and having moving means operatively interconnected to said latch member to move said latch member between said positions thereof only when said moving means of said drive means moves from a first position thereof to a second position thereof, the improvement wherein said latch member is movable from said non-latching position to a third position thereof by said drive means when said drive means tends to move said latch member from said non-latching position thereof to said latching position thereof and said moving means of said drive means moves from said first position thereof to said second position thereof, and switch means carried by said frame means for permitting the heating means of said cooking apparatus to heat clean said cooking chamber means only when said switch means is actuated, said latch member being adapted to actuate said switch means only when said latch member is in said latching position thereof.

14. A latching construction as set forth in claim 13 wherein said latch member has a pivot pin means that is operatively interconnected to said frame means so that said latch member is adapted to be rotated relative to said frame means by said drive means.

15. A latching construction as set forth in claim 14 wherein said frame means has means that is operatively interconnected to said pin means of said latch member to permit said latch member to be rotated relative thereto.

16. A latching construction as set forth in claim 15 wherein said means of said frame means causes said latch member to be rotated from said non-latching position thereof to said third position thereof by said drive means if said door means should not be in said closed condition thereof.

17. A latching construction as set forth in claim 16 wherein said means of said frame means causes said latch member to be rotated by said drive means from said non-latching position thereof to a position intermediate said third position thereof and said non-latching position thereof should said door means be in said closed condition thereof and then move said latch member from said intermediate position thereof to said latching position thereof.

18. A latching construction as set forth in claim 17 wherein the movement of said latch member from said intermediate position thereof to said latching position thereof is substantially a straight line movement thereof.

19. A latching construction as set forth in claim 18 wherein said means of said frame means comprises an elongated slot means in said frame means that receives said pivot pin means therein, said slot means having opposed ends, and spring means operatively interconnected to said latch member and to said frame means to tend to maintain said pivot pin means against one of said ends of said slot means.

20. A latching construction as set forth in claim 19 wherein said latching position of said latch member causes said pivot pin means thereof to be disposed intermediate said opposed ends of said slot means.

21. A latching construction as set forth in claim 19 wherein said latching position of said latch member causes said pivot pin means thereof to be disposed adjacent the other of said ends of said slot means.

22. A latching construction as set forth in claim 13 wherein said drive means comprises a motor means carried by said frame means and having a rotatable output shaft means, a plate means carried by said shaft means to rotate in unison therewith, and means carried by said plate means in offset relation to said shaft means and being operatively interconnected to said latch member to move said latch member in relation to rotation of said plate means by said motor means.

23. A latching construction as set forth in claim 22 wherein said means carried by said plate means comprises an elongated rod means having opposed ends respectively rotatably interconnected to said plate means and to said latch member.

24. A latching construction as set forth in claim 22 wherein said means carried by said plate means comprises a projection means extending therefrom in spaced parallel relation to said output shaft means, said latch member having an elongated slot means therein, said projection means extending into said slot means of said latch member and being movable therein.

25. In a method of making a cooking apparatus comprising the steps of forming a frame means, forming a cooking chamber means to be carried by said frame means, forming heating means to be carried by said frame means and be adapted to be actuated to heat clean said chamber means, forming switch means for permitting said heating means to heat clean said chamber means only when said switch means is actuated, forming a movable door means to be carried by said frame means for opening and closing said cooking chamber means, forming a movable latch member to be carried by said frame means and be movable between a non-latching position thereof that permits said door means to be opened and closed and a latching position thereof that locks said door means in its closed position if said door means is in its closed position at the time said latch member is moved to said latching position thereof, and forming drive means to be carried by said frame means and have moving means operatively interconnected to said latch member to move said latch member between said positions thereof only when said moving means of said drive means moves from a first position thereof to a second position thereof, the improvement comprising the steps of forming said latch member to be movable from said non-latching position to a third position thereof by said drive means when said drive means tends to move said latch member from said non-latching position thereof to said latching position thereof when said door means is not in a closed condition thereof and said moving means of said drive means moves from said first position thereof to said second position thereof, and disposing said latch member so as to be adapted to actuate said switch means only when said latch member is in said latching position thereof.

26. In a method of making a latching construction for a cooking apparatus having a cooking chamber means and a movable door means for opening and closing said cooking chamber means, said method comprising the steps of forming a frame means, forming a movable latch member to be carried by said frame means and be movable between a non-latching position thereof that would permit said door means to be opened and closed and a latching position thereof that would lock said door means in its closed position if said door means is in its closed position at the time said latch member is moved to said latching position thereof, and forming drive means to be carried by said frame means and have moving means operatively interconnected to said latch member to move said latch member between said positions thereof only when said moving means of said drive means moves from a first position thereof to a second position thereof, the improvement comprising the steps of forming said latch member to be movable from said non-latching position to a third position thereof by said drive means when said drive means tends to move said latch member from said non-latching position thereof to said latching position thereof if said door means should not be in a closed condition thereof and said moving means of said drive means moves from said first position thereof to said second position thereof, forming switch means to be carried by said frame means for permitting the heating means of said cooking apparatus to heat clean said cooking chamber means only when said switch means is actuated, and disposing said latch member so as to be adapted to actuate said switch means only when said latch member is in said latching position thereof.

* * * * *

UNITED STATES PATENT AND TRADEMARK OFFICE

CERTIFICATE OF CORRECTION

PATENT NO. : 4,927,996

DATED : May 22, 1990

INVENTOR(S) : Francis S. Genbauffe et al

It is certified that error appears in the above—identified patent and that said Letters Patent is hereby corrected as shown below:

Column 15, line 46, after "thereof" insert --if said door means should not be in a closed condition thereof--

Signed and Sealed this

Twenty-first Day of July, 1992

*Attest:*

DOUGLAS B. COMER

*Attesting Officer*

*Acting Commissioner of Patents and Trademarks*